US005329666A

United States Patent [19]

Bowerman et al.

[11] Patent Number: 5,329,666

[45] Date of Patent: Jul. 19, 1994

[54] VACUUM CLEANER

[75] Inventors: Leonard E. Bowerman, Abingdon, Va.; Eugene K. Chumley, Mt. Carmel, Tenn.; Raymond D. Owens, Bristol, Va.; William E. Bartasevich, Kent, Ohio; Robert L. Waldo, Hiram, Ohio; John R. Caterinacci, Maple Heights, Ohio

[73] Assignee: TRC Aquisition Corporation, Atlanta, Ga.

[21] Appl. No.: 77,618

[22] Filed: Jun. 15, 1993

Related U.S. Application Data

[60] Division of Ser. No. 871,905, Apr. 21, 1992, Pat. No. 5,218,736, which is a division of Ser. No. 722,370, Jun. 25, 1991, Pat. No. 5,129,128, which is a continuation of Ser. No. 464,252, Jan. 12, 1990, abandoned.

[51] Int. Cl.[5] ..... A47L 9/26

[52] U.S. Cl. ..... 15/323; 15/344

[58] Field of Search ..... 15/323, 344

[56] References Cited

U.S. PATENT DOCUMENTS

| | | | |
|---|---|---|---|
| 2,069,949 | 2/1937 | Goldberg | 15/344 X |
| 2,309,583 | 1/1943 | Frantz | 15/16 |
| 2,418,130 | 4/1947 | Lofgren | 15/323 X |
| 3,166,777 | 1/1965 | Frantz | 15/323 |
| 3,170,184 | 2/1965 | Jepson et al. | 15/323 |
| 3,178,128 | 4/1965 | Meletti | 242/107.2 |
| 3,251,107 | 5/1966 | Scott | 24/134 |
| 3,350,858 | 11/1967 | Verhagen | 55/376 |
| 3,667,084 | 6/1972 | Valbona et al. | 15/323 |
| 3,966,444 | 6/1976 | Clowers et al. | 55/356 |
| 4,011,624 | 3/1977 | Proett | 15/344 |
| 4,209,875 | 7/1980 | Pugh et al. | 15/344 |
| 4,685,171 | 8/1987 | Beaudoin | 15/391 |
| 4,800,614 | 1/1989 | Kopco et al. | 15/344 X |
| 5,014,385 | 5/1991 | Bradd et al. | 15/323 |

FOREIGN PATENT DOCUMENTS 990065 4/1965 United Kingdom .

*Primary Examiner*—Chris K. Moore
*Attorney, Agent, or Firm*—Jones & Askew

[57] ABSTRACT

A hand-held corded vacuum cleaner having a housing with a motor compartment containing a motor mounted on partitions defining inlet, cooling and outlet chambers for efficient motor cooling by air which enters inlet and exits outlet vents in the inlet and outlet chambers, respectively. A dirt channel extends from a fan chamber having a fan mounted by being swaged on a motor shaft. A nozzle chamber is disposed at one end of the housing and a bag assembly is removably detached from the rear of the housing by means of a collar having a side hole through which a detent extends and which may be depressed to remove the bag assembly. The nozzle is in communication with the fan chamber and the fan pushes dirt through a dirt channel over the motor compartment into the bag of the bag assembly. The motor shaft has a pulley at the end thereof which is connected to a brush which is releasably retained in the nozzle compartment. A belt extends around the brush and the pulley. A door provides access to the belt and has a post which is coaxial with the motor shaft and extends into the immediate proximity of the end thereof to prevent the belt from meandering off the shaft. A well in the belly of the housing and a cooperating well defined between projections on the handle provide a receptacle for the line cord when it is wound around the housing and handle.

2 Claims, 21 Drawing Sheets

VACUUM CLEANER

This is a division of application Ser. No. 07/871,905, filed Apr. 21, 1992 now U.S. Pat. No. 5,218,736 issued Jun. 15, 1993.

DESCRIPTION

The present invention relates to vacuum cleaners and particularly to a corded hand-held vacuum cleaner.

The invention is especially adapted for use in a vacuum cleaner of the so-called "dirty fan" type wherein dirt picked up by the fan is carded through a dirt channel into a filter bag. Aspects of the invention may be found applicable to other vacuum cleaners.

Vacuum cleaners which are adapted to be hand-held in operation have been the subject matter of technical activity for almost a century. Such vacuum cleaners have been available in both cordless and corded models. Patents which trace the development of corded hand-held vacuum designs are Clarke U.S. Pat. No. 1,740,918 and Clarke French 642815 of 1927; Frantz 2,314,334, Snyder 2,184,446; Kitto 1,878,852; Sovis 4,633,543 and 14,685,171. An example of a cordless hand-held vacuum is Pugh 4,209,875. Nevertheless, consumers are still seeking a vacuum cleaner which has strong suction power, is reliable and is low in cost.

It is the principal object of this invention to provide an improved vacuum cleaner which will satisfy the needs of most consumers by providing features and combinations of features which are not available to consumers at this time and which provides strong suction power while maintaining reliability,and at a cost which is competitive with corded hand-held vacuum cleaners which have heretofore been available.

Briefly described, the invention provides a vacuum cleaner which is capable of being hand-held. The vacuum cleaner has a housing with a nozzle compartment, a fan compartment, a motor compartment, a filter bag assembly detachably connectable to the housing and a channel through the housing from the fan compartment to bring dirt collected by the nozzle to the bag to facilitate the collection of dirt. The motor, which is disposed in the motor compartment, is provided with an efficient air cooling system so that it can create a powerful vacuum by rotating a fan in a fan chamber in communication with the nozzle compartment. To facilitate the collection of dirt, a brush is rotatably mounted in the nozzle compartment across an opening into the nozzle. A belt around the pulley at the end of the motor shaft rotatably couples the brush to the shaft. The vacuum cleaner has one or more of the following features:

(a) The motor compartment cooling efficiency is enhanced by mounting the motor on a plurality of partitions which divide the motor compartment into inlet and outlet chambers between which a cooling chamber is disposed. The cooling chamber provides separation of the inlet and outlet compartments and inlet and outlet vents into which cooling air is drawn into the inlet compartment and exhaust from the outlet compartment. The cooling chamber provides a large volume of air contacting the motor. The cooler air flows through the motor, which has passages between the armature and stator, so that the motor is cooled efficiently thereby allowing the motor to run at higher power level (higher amperage) so that increased suction power is obtained from the fan and the brush is maintained in motion without overloading the motor.

(b) A bag assembly is provided which has a filter bag with an open end. A collar surrounds this open end. A detent in an end section of the housing enters a side opening in the collar. When the detent is depressed, the collar and bag assembly can be easily removed. The detent also allows the bag assembly to be rapidly attached and latched into place on the housing.

(c) The nozzle compartment is provided with an improved mechanism for retaining the brush. End caps on bearings on which the brush rotates are disposed in receptacles. The receptacles have projections, preferably provided by wedges extending inwardly from the side walls. To insert the brush, it is pushed into the receptacles and the end caps snap into place. No sole plates are needed. The receptacles prevent the brush from dropping out of the nozzle compartment should the belt break.

(d) The nozzle compartment is also provided with a door through which access can be had to the motor pulley so that the belt can be replaced. To prevent the belt from meandering off the pulley, a post on the door moves, when the door is closed, into a position where it is coaxial with and in the immediate proximity of the end of the shaft. If the belt tends to meander off the pulley, which might occur if the brush is rotated by hand in a direction opposite to the direction it is rotatable when collecting dirt, the post then prevents the belt from moving off the pulley.

(e) In order to secure or stow the power line cord, the housing is provided with wells in its underside or belly and on the handle by projections which are spaced from each other along the handle. The cord is wound around these wells which retain the cord in position so that it cannot slip off the housing and handle and uncoil.

(f) A motor shaft and fan assembly enables the fan to be securely mounted on the motor shaft without the need for threaded fasteners. This mounting is provided by splines on the motor shaft in the portion thereof which receives the fan. The fan has a hole therethrough along its axis of rotation. In this hole an insert of metal is received. Preferably the insert is bonded to the fan, as by ultrasonic bonding techniques. The insert is of material which is softer than the shaft. The fan including the insert is then pressed on so that the splines are swaged into the insert thereby providing a permanent secure coupling of the fan to the shaft.

The foregoing and other objects, features and advantages of the invention, as well as a presently preferred embodiment thereof, will become more apparent from a reading of the following description in connection with the accompanying drawings in which.

Figure 19:
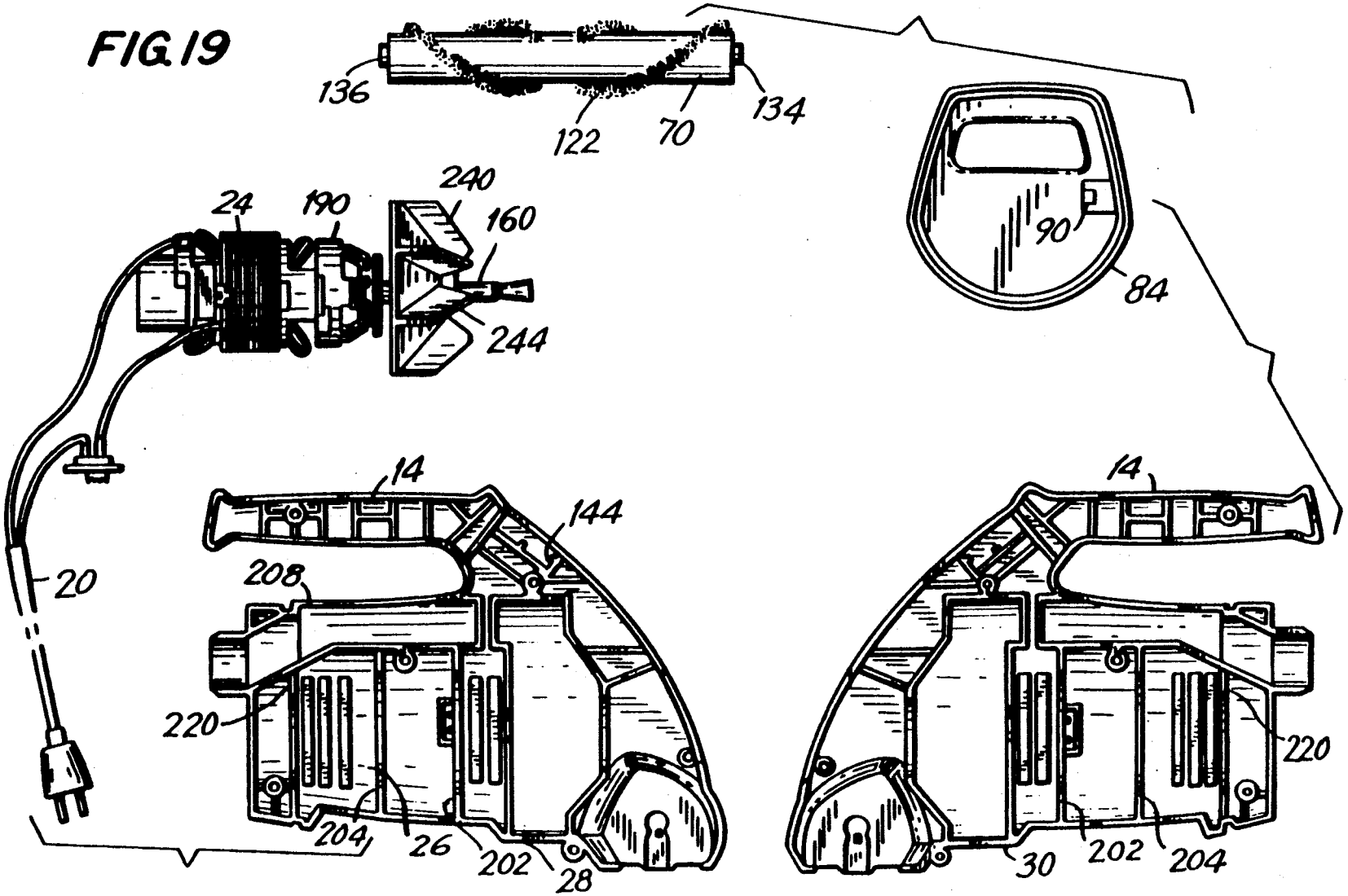
FIG. 19 is an exploded view similar to FIG. 18 which better shows the louvers in the motor compartment, the chamber for holding the detent button in the end section of the housing, the motor with the fan assembled to the motor shaft and the brush with the shaft inserted, but with the end caps partially removed.
Figure 20:
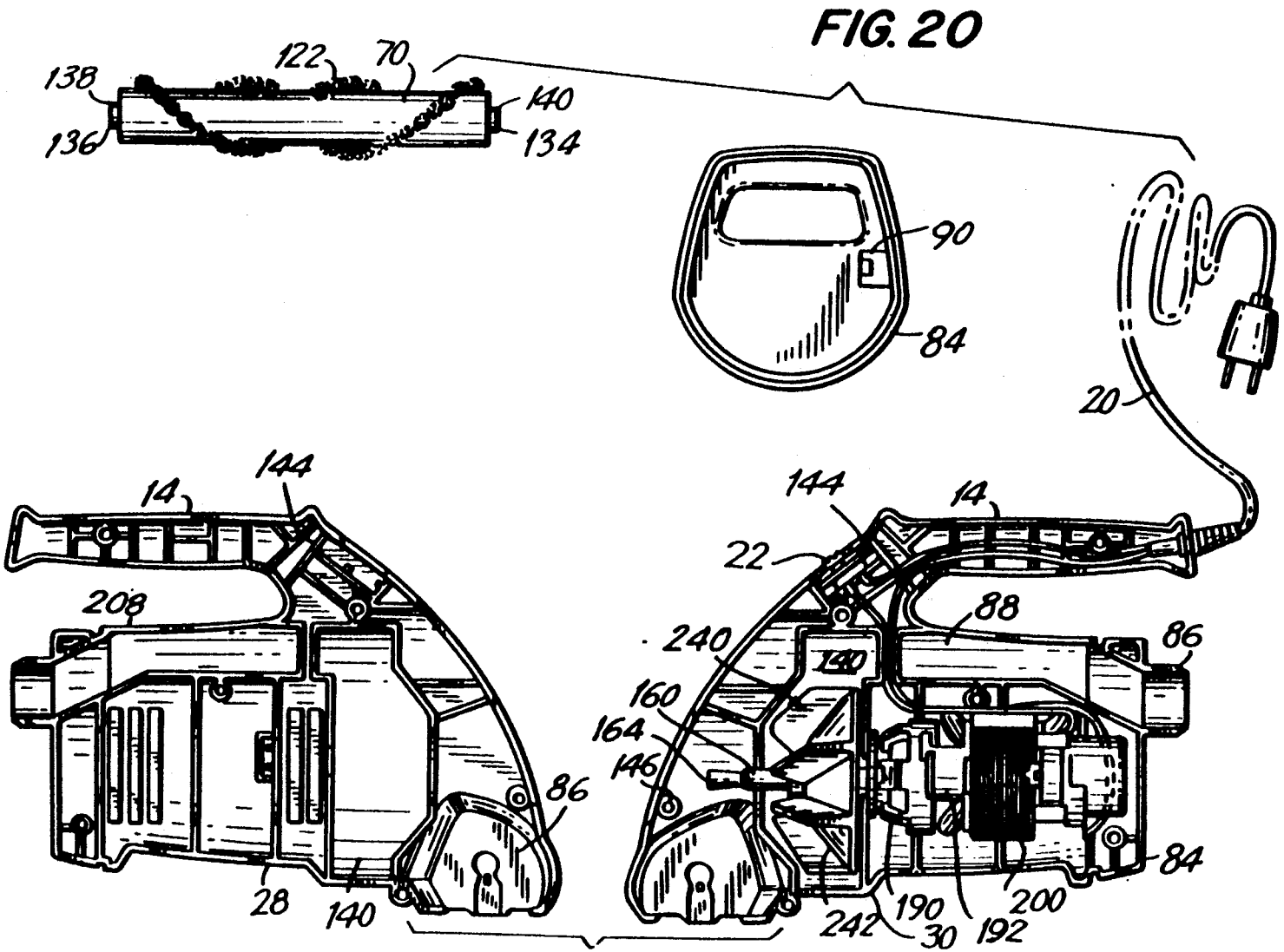
Figure 21:
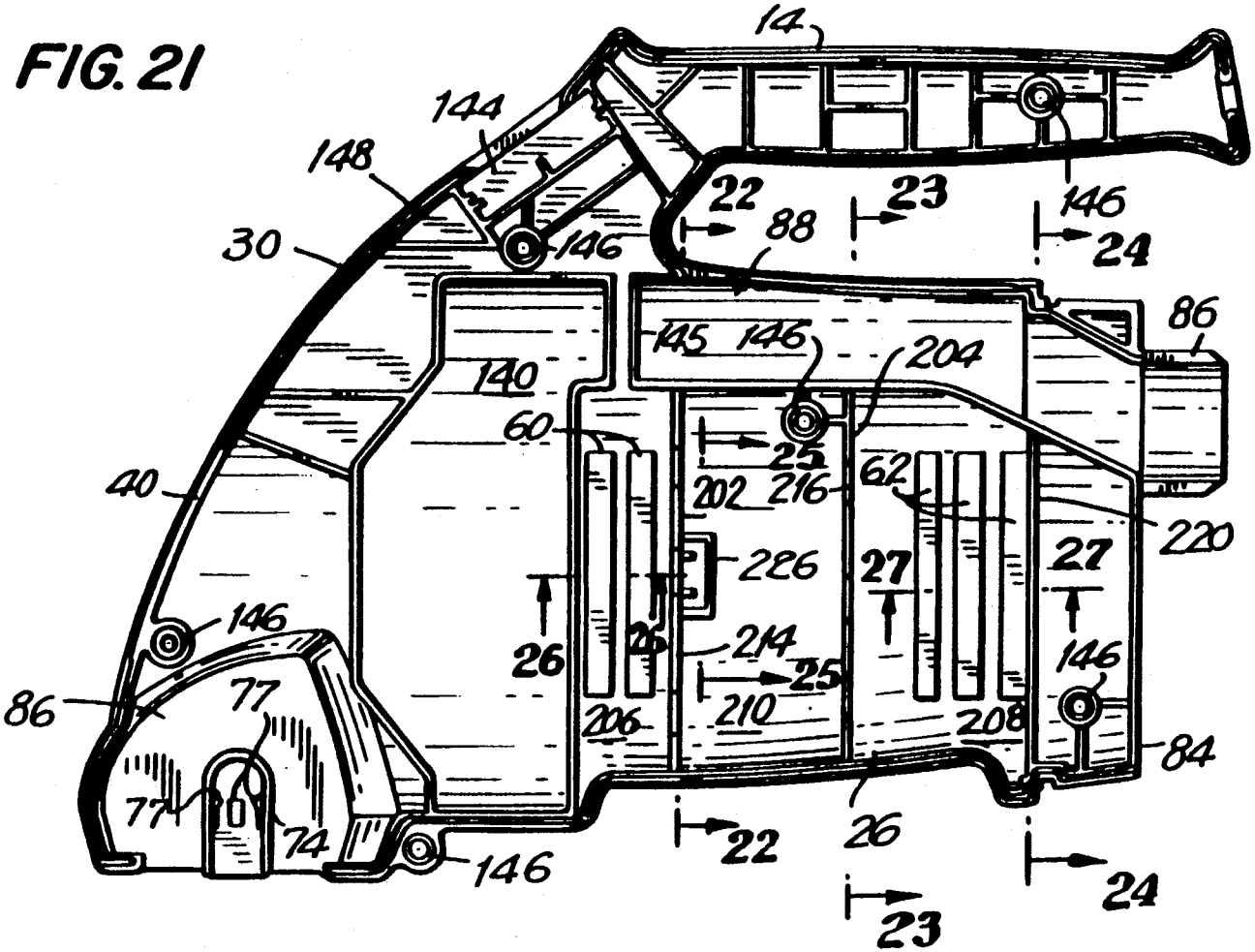
Figure 24:
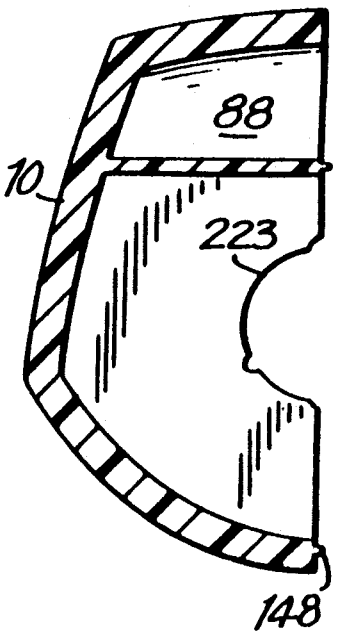
Figure 25:
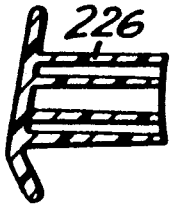
Figure 23:
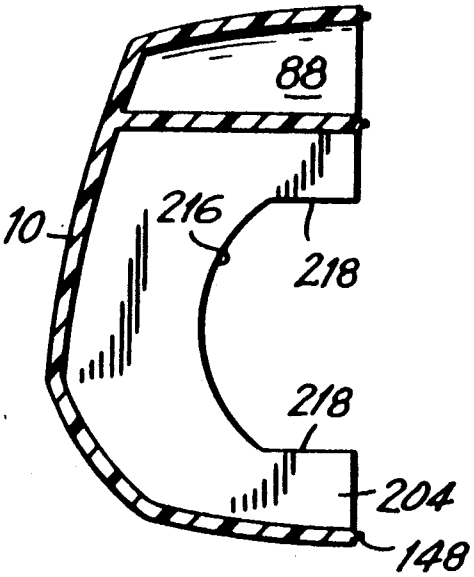
Figure 27:
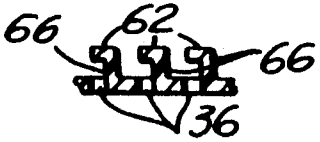
Figure 22:
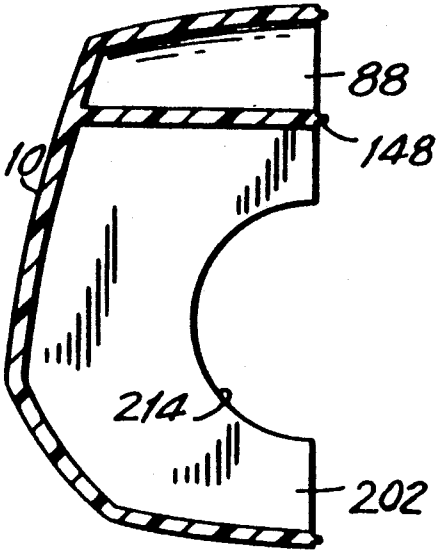
Figure 26:
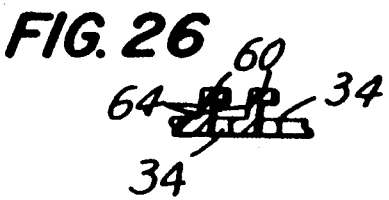
Figure 27A:
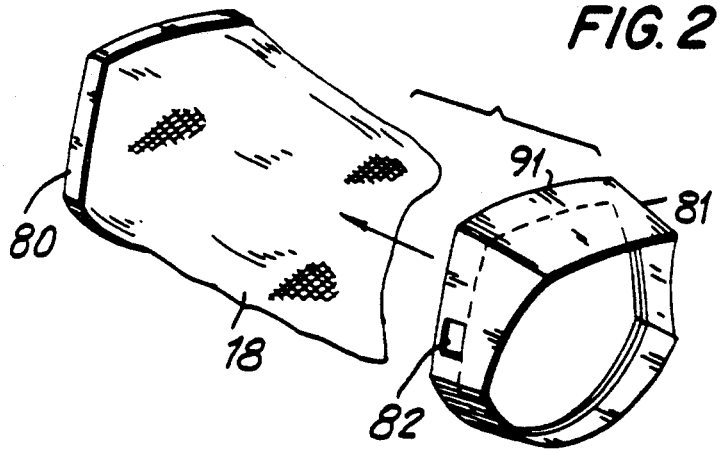
Figure 28:
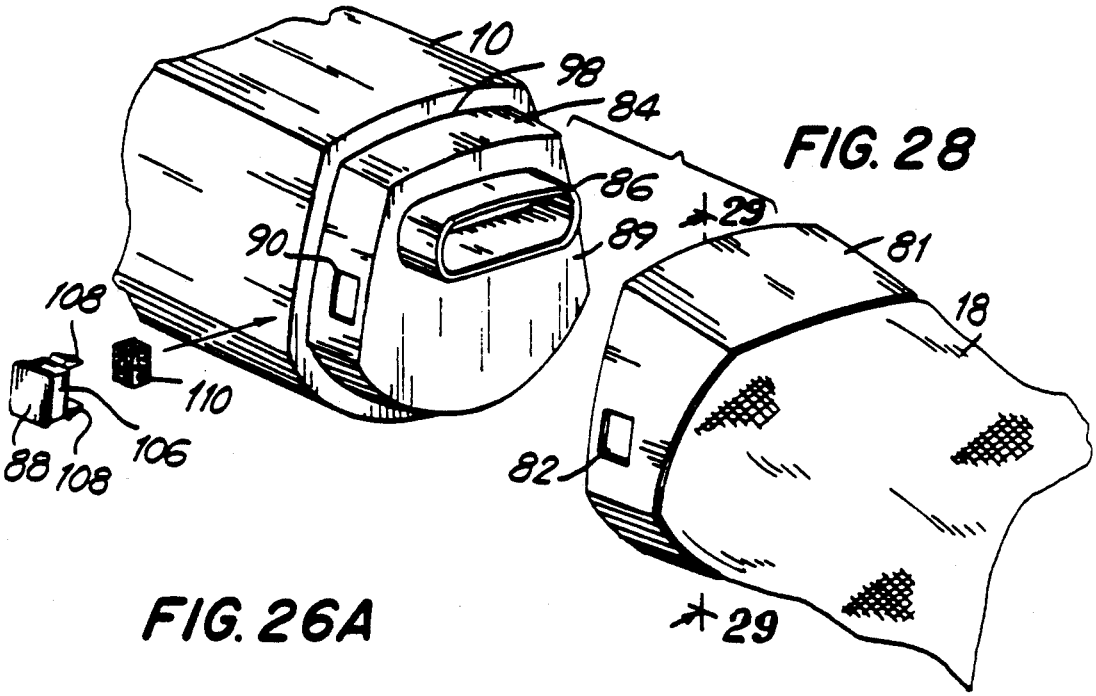
Figure 26A:
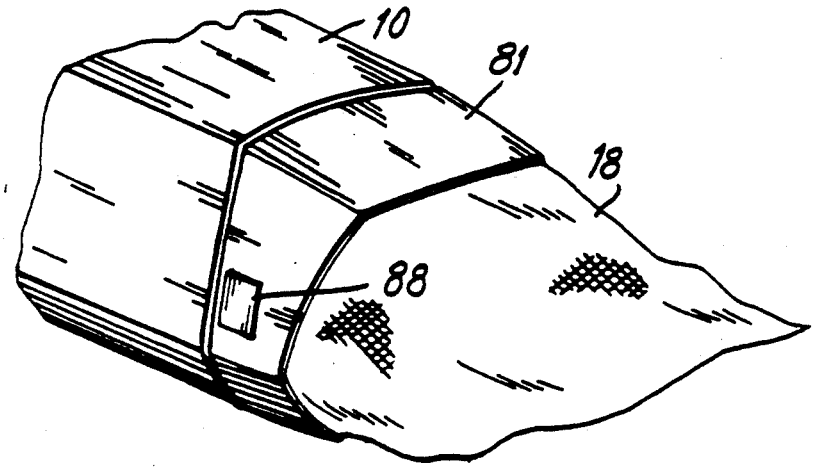
Figure 29:
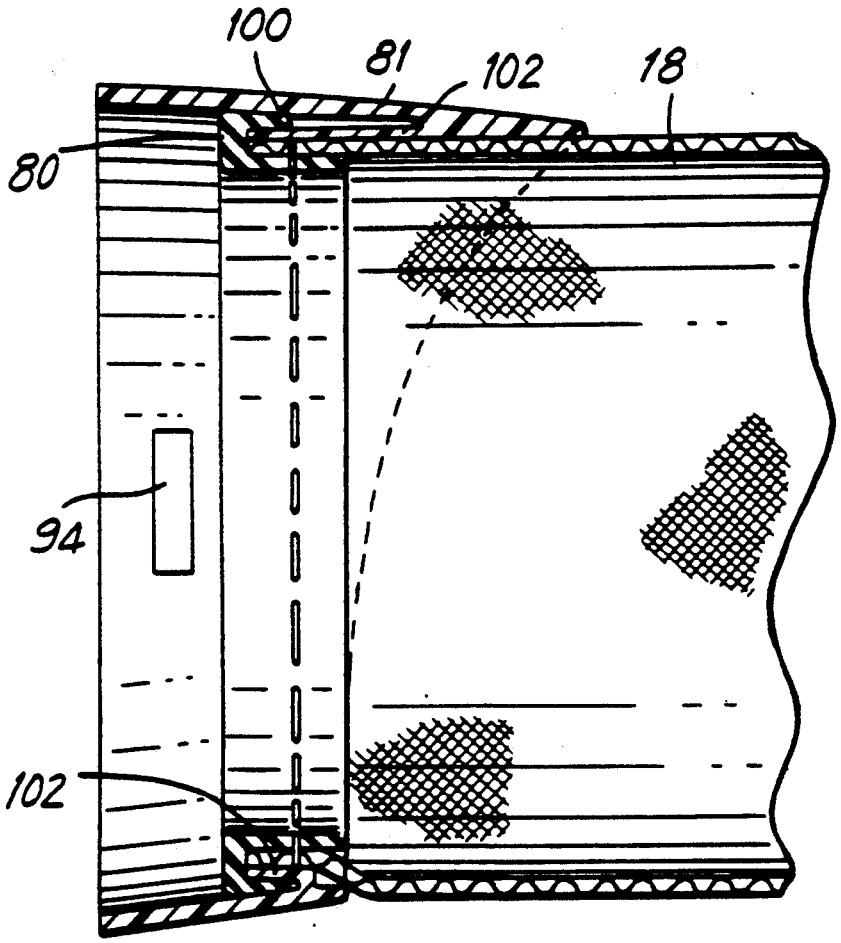
Figure 30:
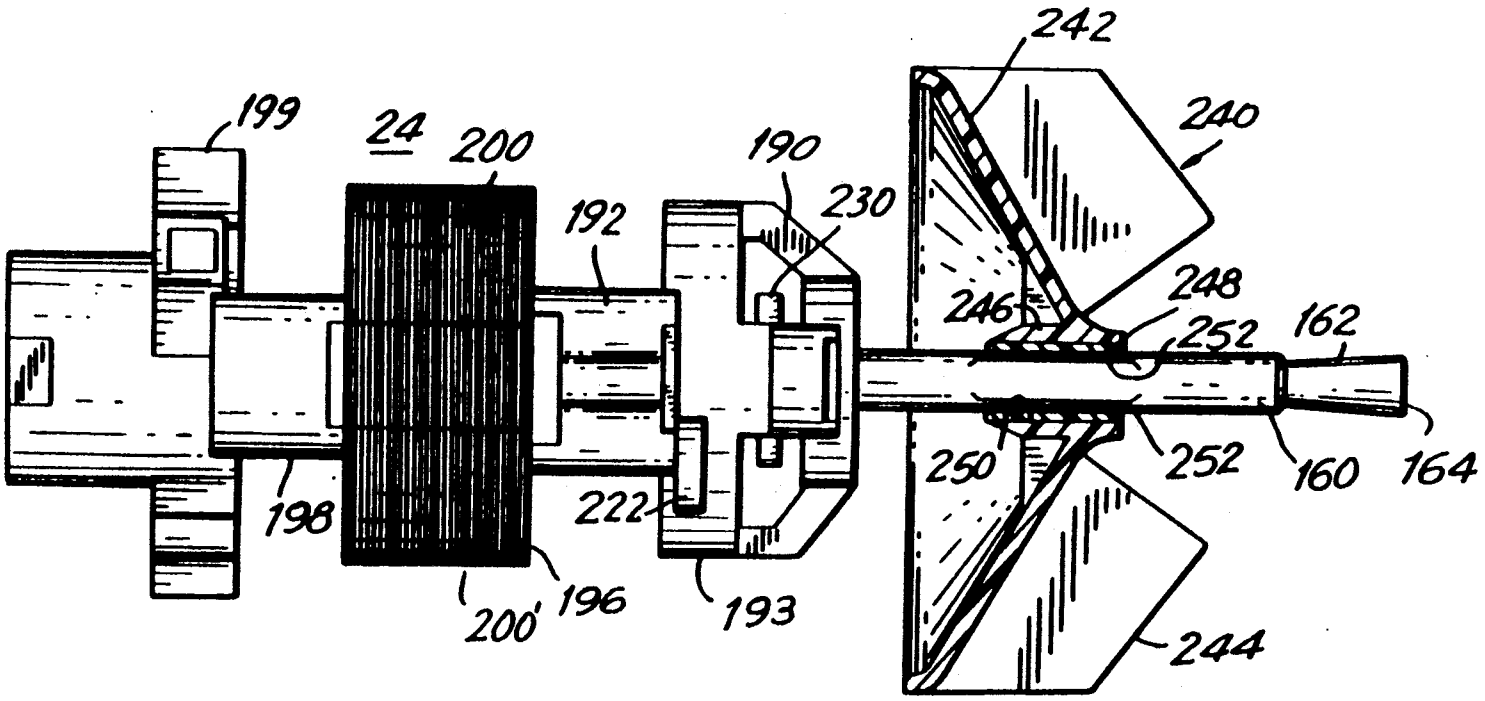
Figure 31:
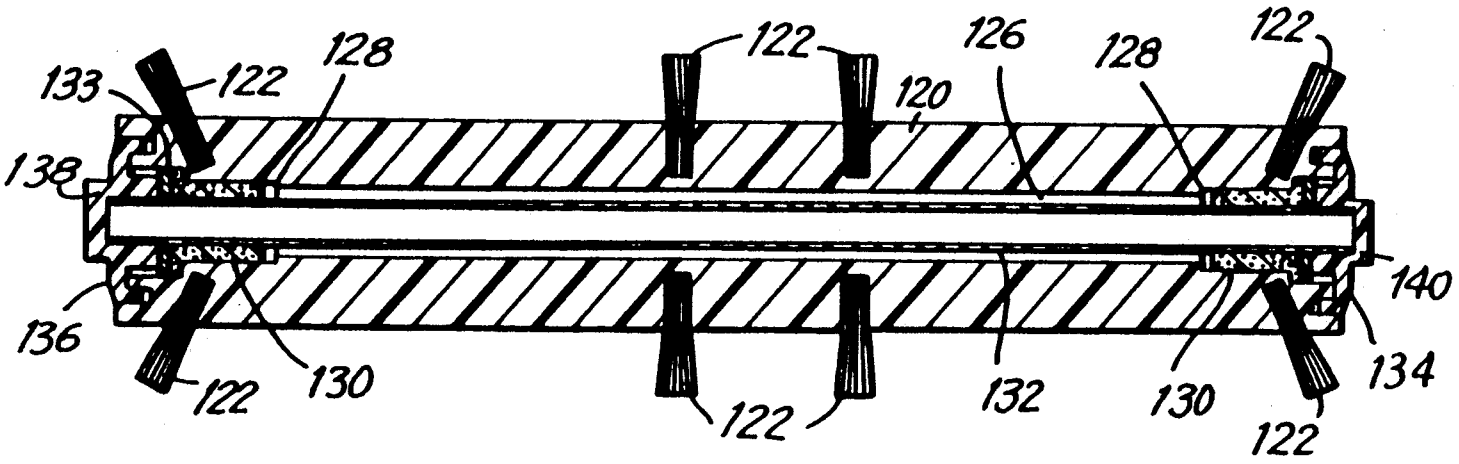
Figure 32:
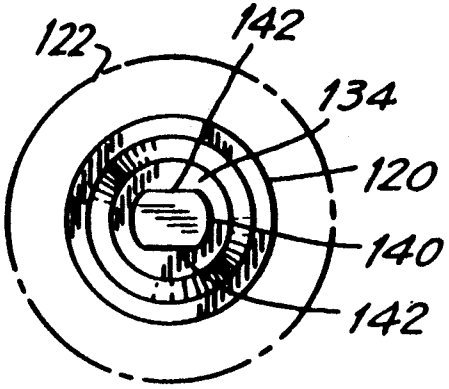

FIG. 20 is an exploded view similar to FIG. 19 with the motor and line cord inserted in the motor compartment and also showing the line cord around the strain relief post in the handle and extending through a conduit across the dirt channel. The conduit is preferably molded integrally with the housing sections as two semi-cylindrical portions which form a tube when the housing sections are assembled together;

FIG. 21 is an elevational view of one of the halves of the bi-part housing of the vacuum cleaner;

FIG. 22 is a section along the line Q—Q in FIG. 21;

FIG. 23 is a section taken along the line R—R in FIG. 21;

FIG. 24 is a sectional view taken along the line S—S in FIG. 21;

FIG. 25 is a fragmentary sectional view taken along the line T—T in FIG. 21 and showing the motor tab receiving compartment of the housing section shown in FIG. 21;

FIG. 26 is a fragmentary sectional view showing the inlet chamber vents and backing louvers;

FIG. 27 is a fragmentary sectional view taken along the line V—V in FIG. 21 showing the louvers backing the vents in the outlet chamber of the housing half shown in FIG. 21;

FIG. 26A is a fragmentary perspective view showing the bag assembly;

FIG. 27A is a fragmentary perspective view showing the collar and the bag and its gasket of the bag assembly;

FIG. 28 is an exploded view showing the end section of the housing, the detent button, the foam spring and the bag and its outer bag ring or collar;

FIG. 29 is a fragmentary sectional view of the bag and collar, the section being taken along the line 29—29 in FIG. 28 when viewed in the direction of the arrows crossing line 29—29;

FIG. 30 is a fragmentary, partially sectional view of the motor, motor shaft and fan assembly;

FIGS. 31 and 32 are respectively sectional views and a right side end view of the brush assembly.

Referring to FIGS. 1 to 7 there is shown an exemplary embodiment of a hand-held vacuum cleaner in accordance with the invention. This vacuum cleaner has a housing 10 with a nozzle 12 and a handle 14. A bag assembly 16 is attached to the end section of the housing. A filter bag 18 of fabric material, conventionally used as a dirt filter in vacuum cleaners, projects from the end of the bag assembly 16. A power line cord 20 enters the rear end of the handle 14 and proceeds to a switch 22 which turns the power on and off to a motor in the housing. The motor 24 is shown in FIGS. 18 to 24 and 30. It is contained in a motor compartment 26 shown in FIGS. 18 to 21 which are formed when the two halves or parts 28 and 30 (see also FIGS. 18 to 21) are joined together along their longitudinal parting plane.

Inlet vents 34 and outlet vents 36 for cooling air, which passes through the motor compartment and cools the motor, are provided. There are a plurality (two) inlet vents 34 and another plurality (three) outlet vents or exhaust vents 36 in each housing part 28 and 30.

The nozzle 12 is part of a nozzle compartment having an access opening 40 which is closed by a door 42. The housing parts are preferably assembled by screws as will be discussed hereinafter in connection with the embodiment shown in FIG. 21. However, the parts may be secured together along the edges thereof which define the assembly plane. Glue or other securing means may be used.

Figure 1:
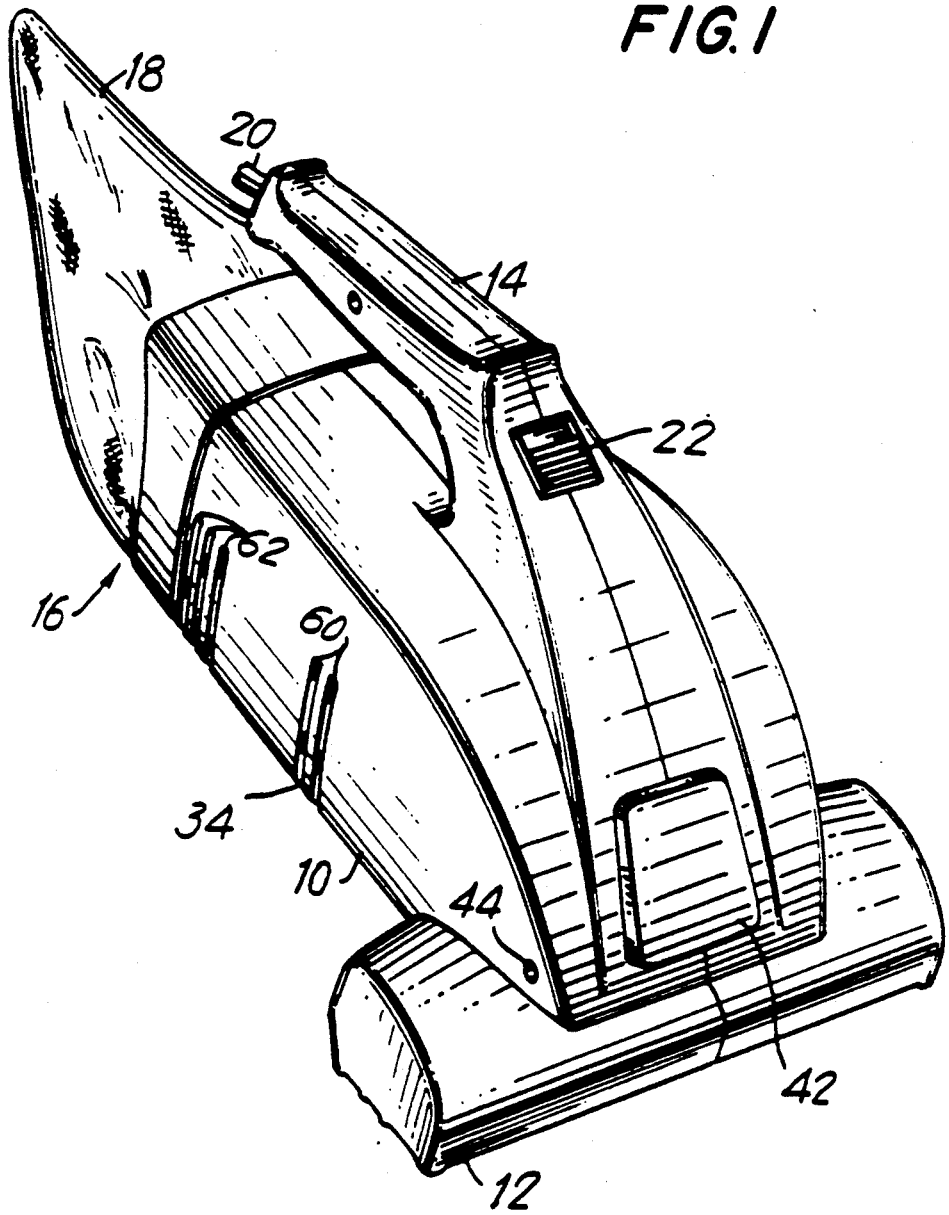
FIG. 1 is a perspective view of a hand-held corded vacuum cleaner embodying the invention.
Figure 2:
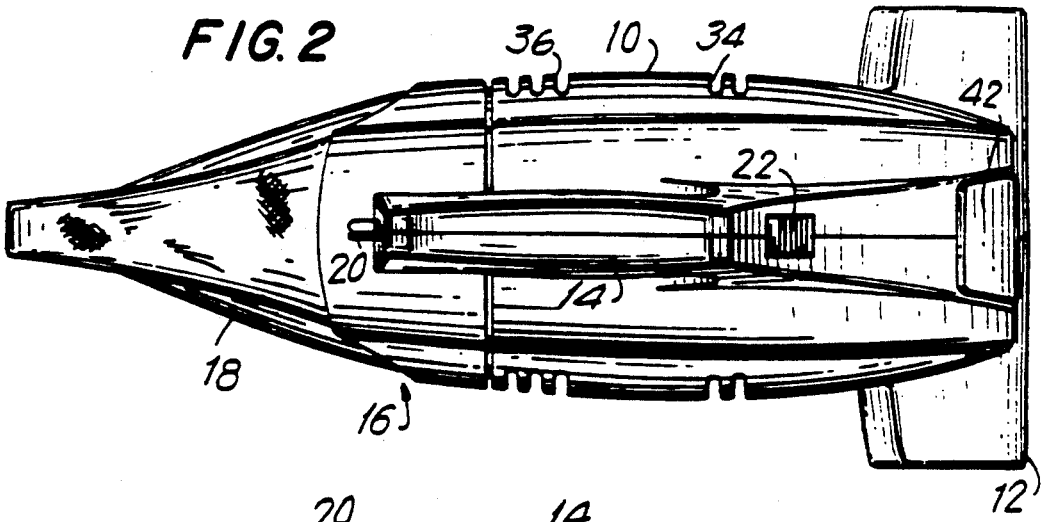
FIG. 2 is a plan view of the vacuum cleaner shown in FIG. 1.
Figure 5:
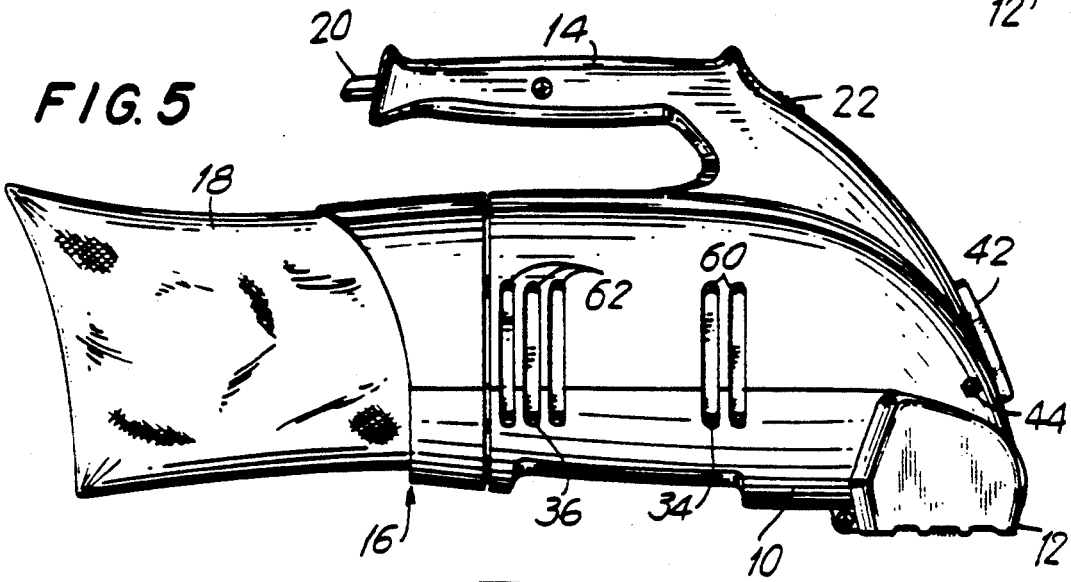
FIG. 5 is a left side view thereof.
Figure 6:
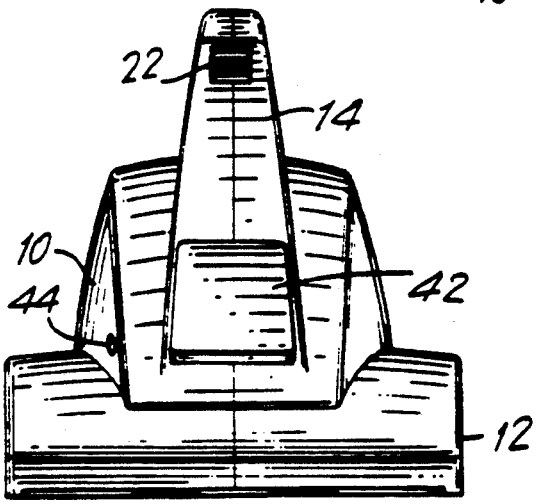
FIG. 6 is a front view thereof.
Figure 3:
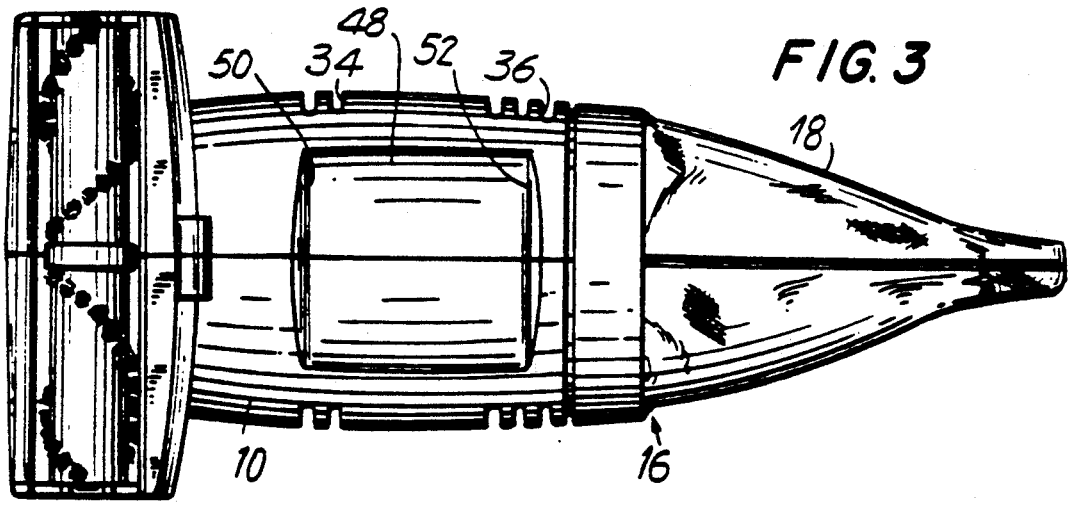
FIG. 3 is a bottom view of the vacuum cleaner shown in FIG. 1.
Figure 4:
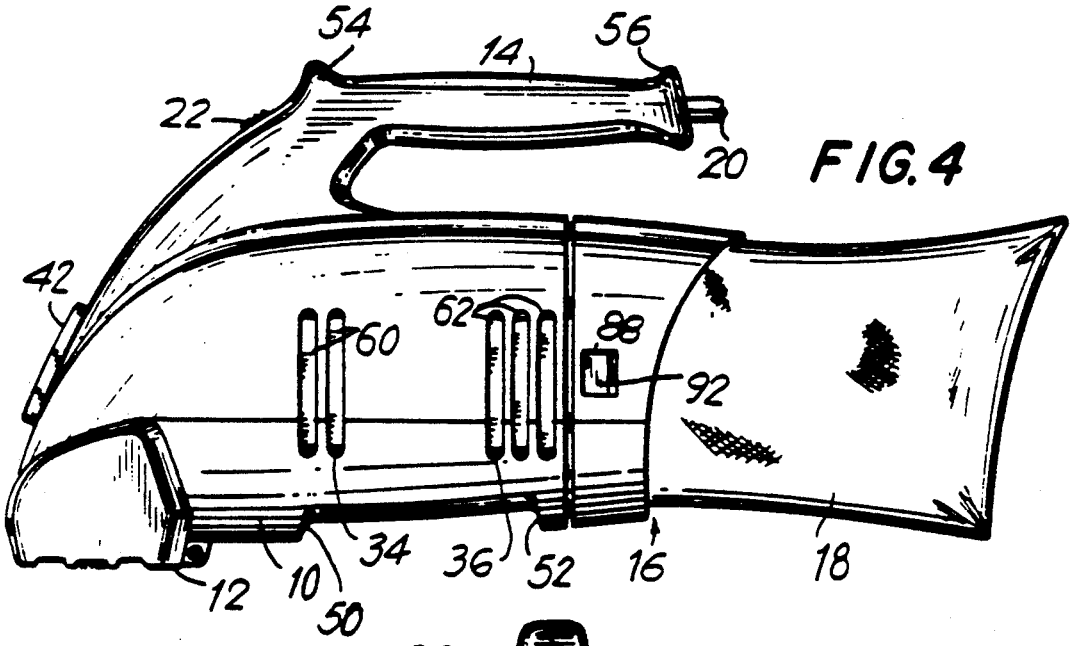
FIG. 4 is a right side view thereof.
Figure 7:
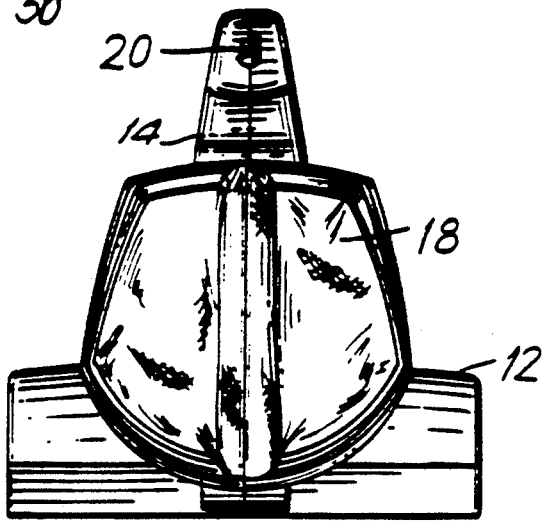
FIG. 7 is a rear view thereof.

As best shown in FIGS. 3, 4 and 5, the bottom or belly of the housing 10 is generally cylindrical in its exterior surface. A flat 48 across the bottom surface provides a receptacle or well with longitudinally spaced end walls 50 and 52. Also the handle 14 is formed with longitudinally spaced projections 54 and 56. These projections 54 and 56 also define a well therebetween. The belly well and the top well on the handle provide areas around which the power line cord 20 can be wound to store the cord around the housing in a position where it will not slip off the housing because of the end walls 50, 52, 54 and 56, when the vacuum cleaner is not in use.

Also as best shown in FIGS. 4 and 5 there are louvers 60 behind the inlet vents and louvers 62 behind the outlet vents 36. These louvers are attached to the inside wall by baffles 64 and 66 as best shown in FIGS. 26 and 27. The cross-sectional configuration of the louvers and baffles is an inverted L. When taken with the housing wall between the vents, the louvers and baffles have a Z shape. The baffles 64 and the louvers 60 direct the cooling air inwardly. The baffles 66 and the louvers 62 direct the exhausting air outwardly and rearwardly to prevent recirculation into the inlet chamber. In other words, the louver-baffle arrangement 60, 64 faces in an opposite direction from the louver-baffle arrangement 62, 66. These arrangements control the flow of cooling air, and have the additional advantage of preventing any persons, particularly small children, from sticking their fingers or other objects into the vacuum cleaner thereby providing a safety feature.

FIG. 3 shows the dirt opening 68 at the bottom of the nozzle 12. A brush 70 is rotatably mounted in the nozzle compartment and is coupled to the motor shaft by an elastomeric (e.g., rubber) belt 72. A feature of the invention is the facility for mounting the brush into receptacles 74 and 76 at the ends of the nozzle compartment 68. These receptacles have means for preventing the brush 70 from falling out, if the belt 72 should break. There are no sole plates or other brackets to secure the brush 70 in the nozzle compartment 68. FIG. 3 also shows a boss 78 which receives one of the screws holding the hi-part housing together.

Figure 8:
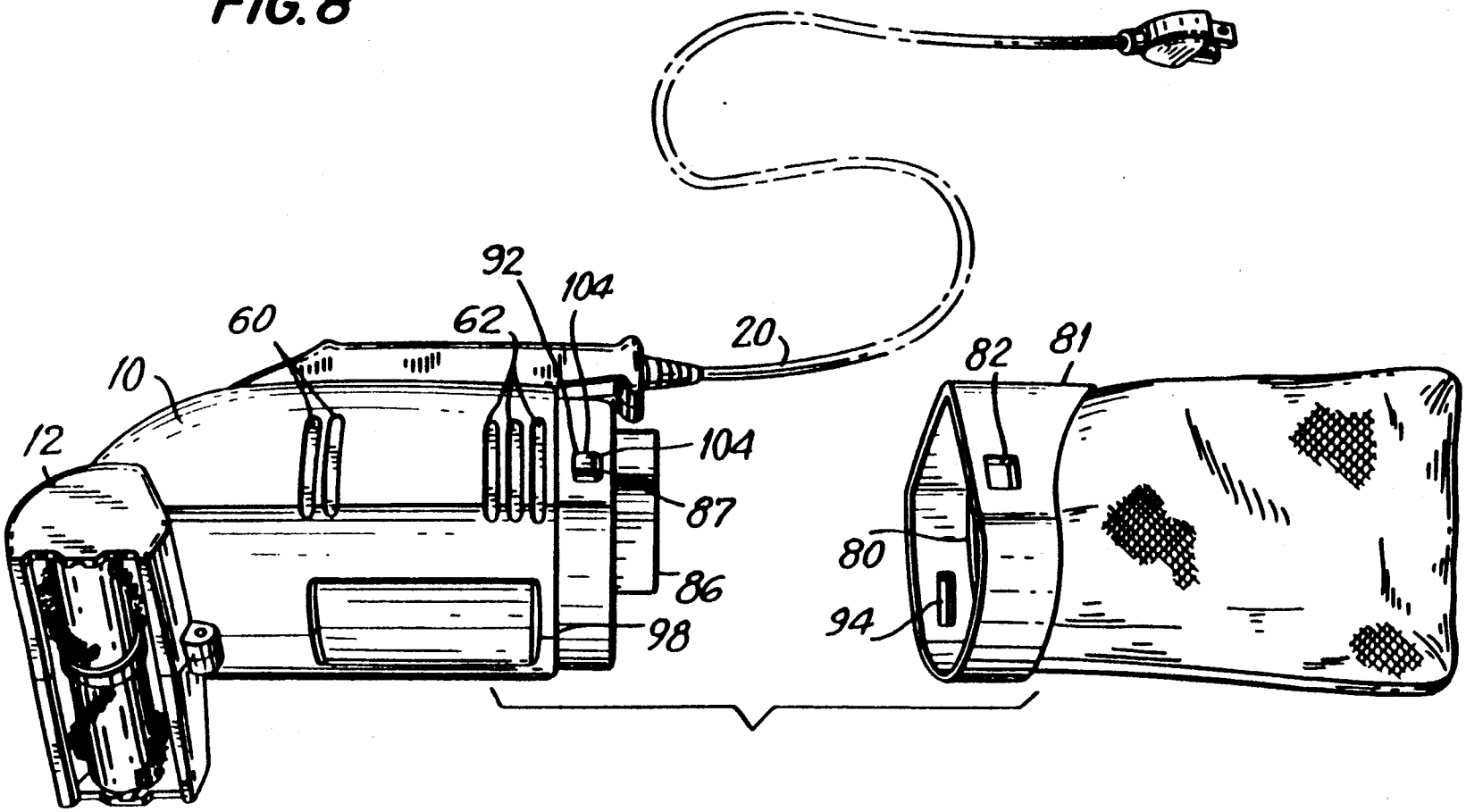
FIG. 8 is a perspective view showing the bag assembly disassembled from the housing of the vacuum cleaner.
Figure 9:
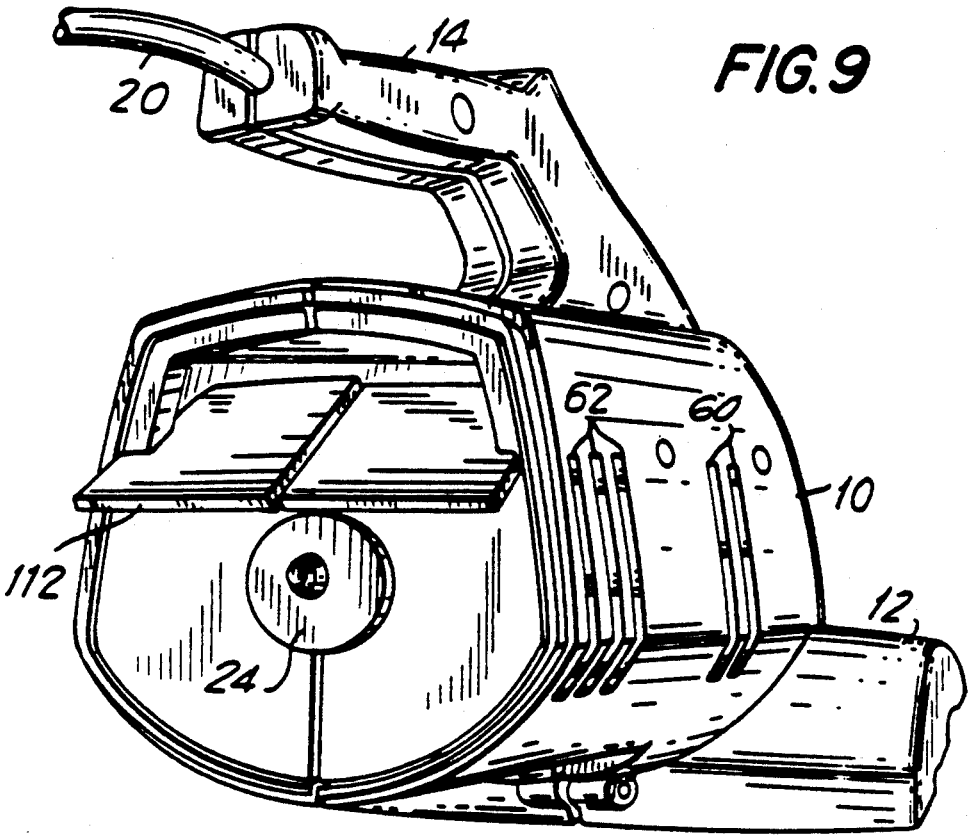
FIG. 9 is a view of the rear of the vacuum cleaner with the end section of the housing removed and with the parts of the housing slightly separated.
Figure 10:
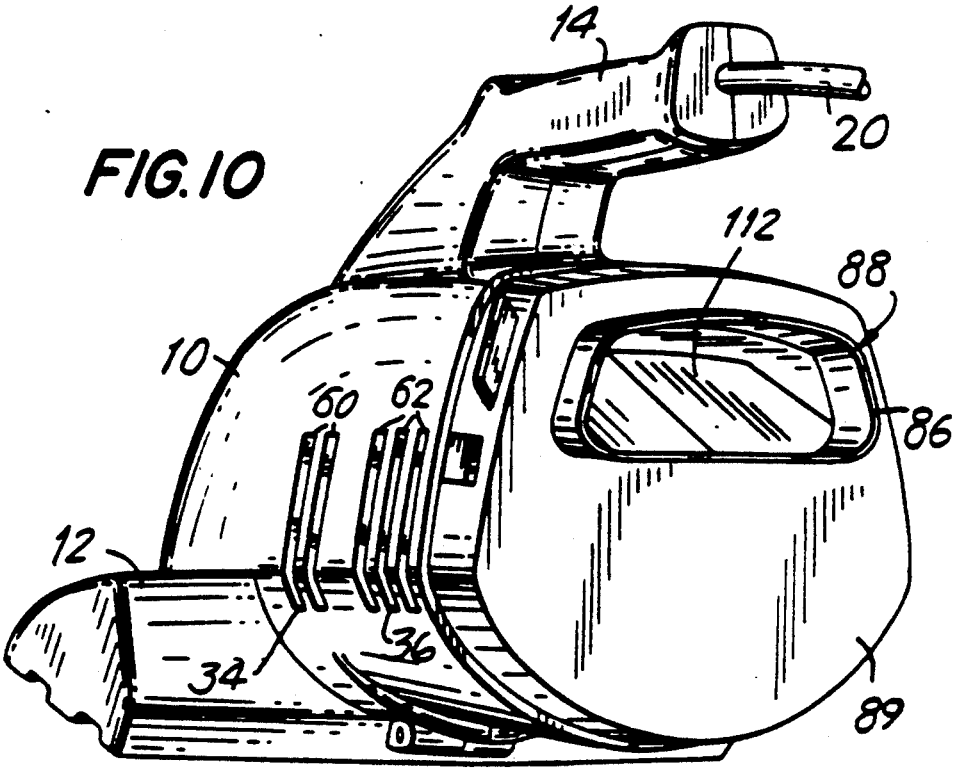
FIG. 10 is a view of the vacuum cleaner from the rear with the end section of the housing in place and the bag assembly removed.

FIG. 4 and also FIG. 8 show the bag assembly 16. This assembly is provided by a collar or ring 81 and the bag 18. The bag 18 has a gasket ring 80 which is recessed within the collar 81. The collar has a side hole 82 which is disposed forwardly of the gasket ring 80 in the assembly 16. The housing 10 has an end section 84, which may be a separate piece attached to the end of the housing (which is shown in FIG. 9) or is an integral part of the bi-part housing, as is the case illustrated in FIG. 21. This end section 84 has a snout 86 which enters the bag and directs dirt therein. The snout is the end of a dirt channel 88 which will be observed in FIGS. 9, 10 and 18 to 20 as well as FIG. 21. The end section 84 has an opening 87 into a compartment 90 (see FIGS. 18 to 20). Behind the opening 87 is a detent button 92. This button is tapered forwardly so that its rear (the part closer to the bag 18 than to the nozzle 12) defines a ramp over which the bag and its collar 81 can be slipped. Then, the detent button snaps out into the side opening 82. Because of the spacing of the gasket ring 80 with respect to the opening 82, the gasket ring 80 will abut against the back of the end section 84 and form a seal around the opening to the bag 18.

Figure 11:
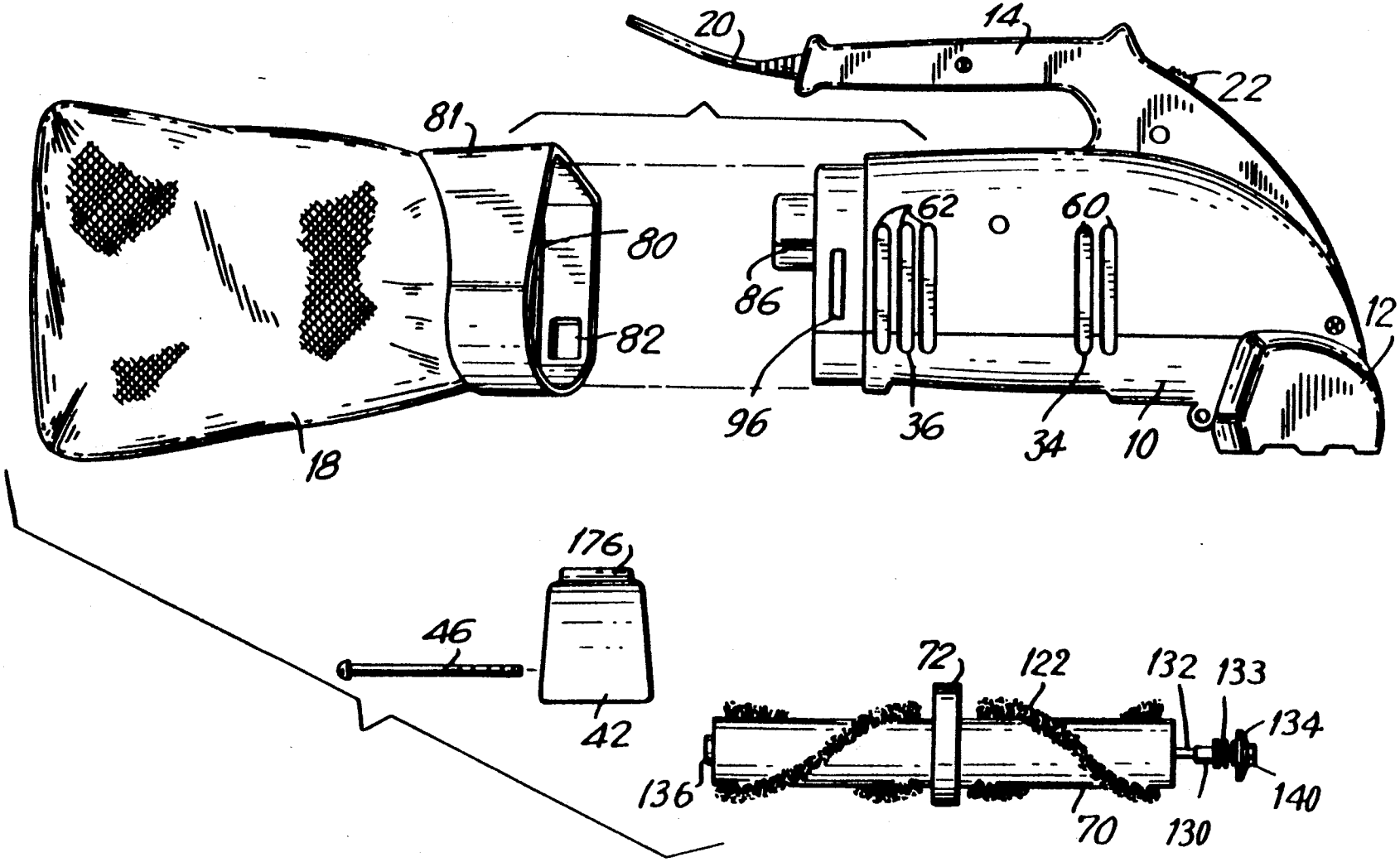
FIG. 11 is an exploded view of the vacuum cleaner showing the housing, the bag assembly, the door for closing the opening at the front of the nozzle compartment, the screw which secures the door in place, and the brush with the shaft and one end cap partially removed from the brush and with the belt around the brush.
Figure 12:
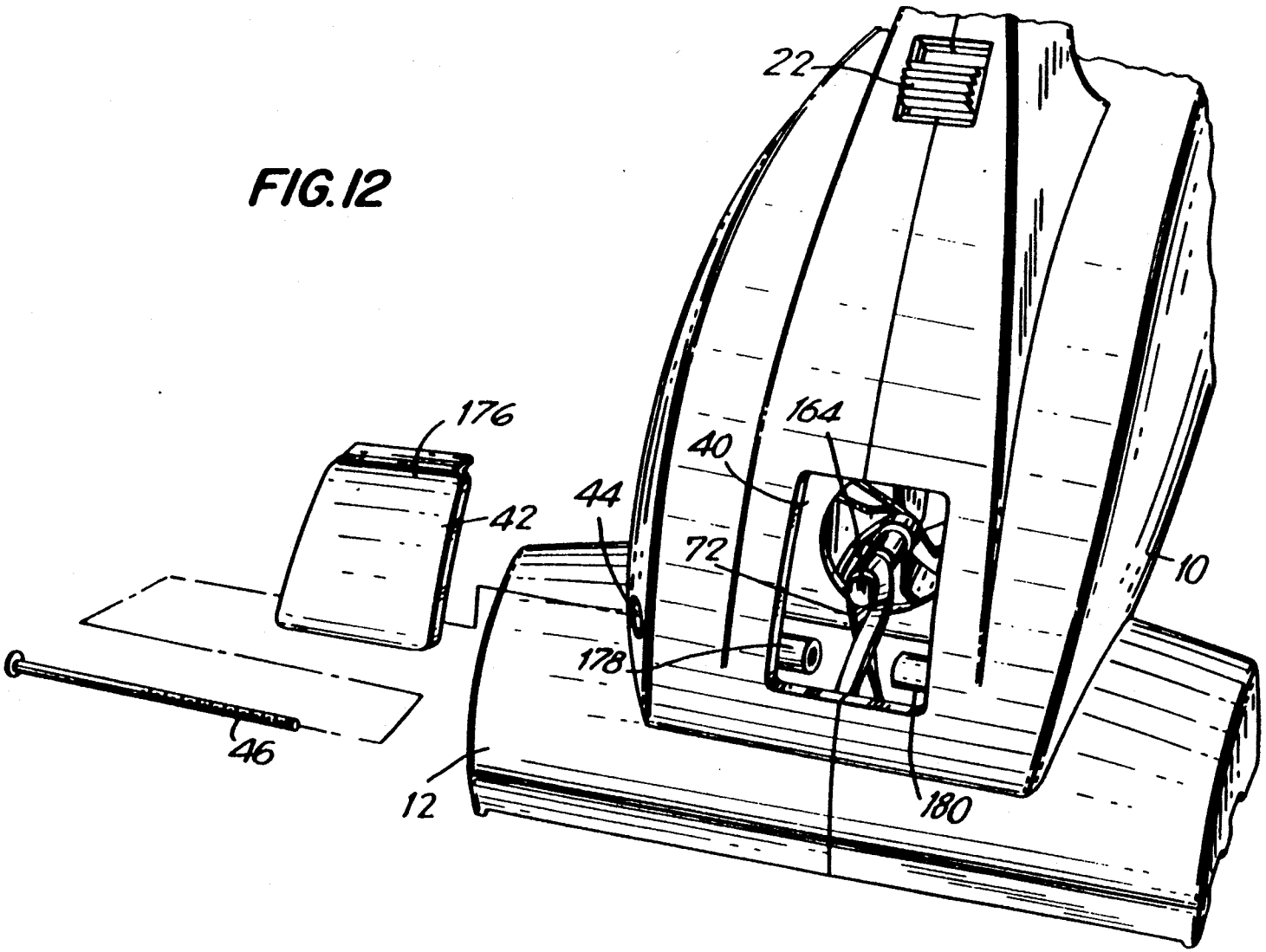
FIG. 12 is a view of the vacuum cleaner with the door removed and showing the belt and part of the motor shaft and brush, the access door and its retaining screw.
Figure 13:
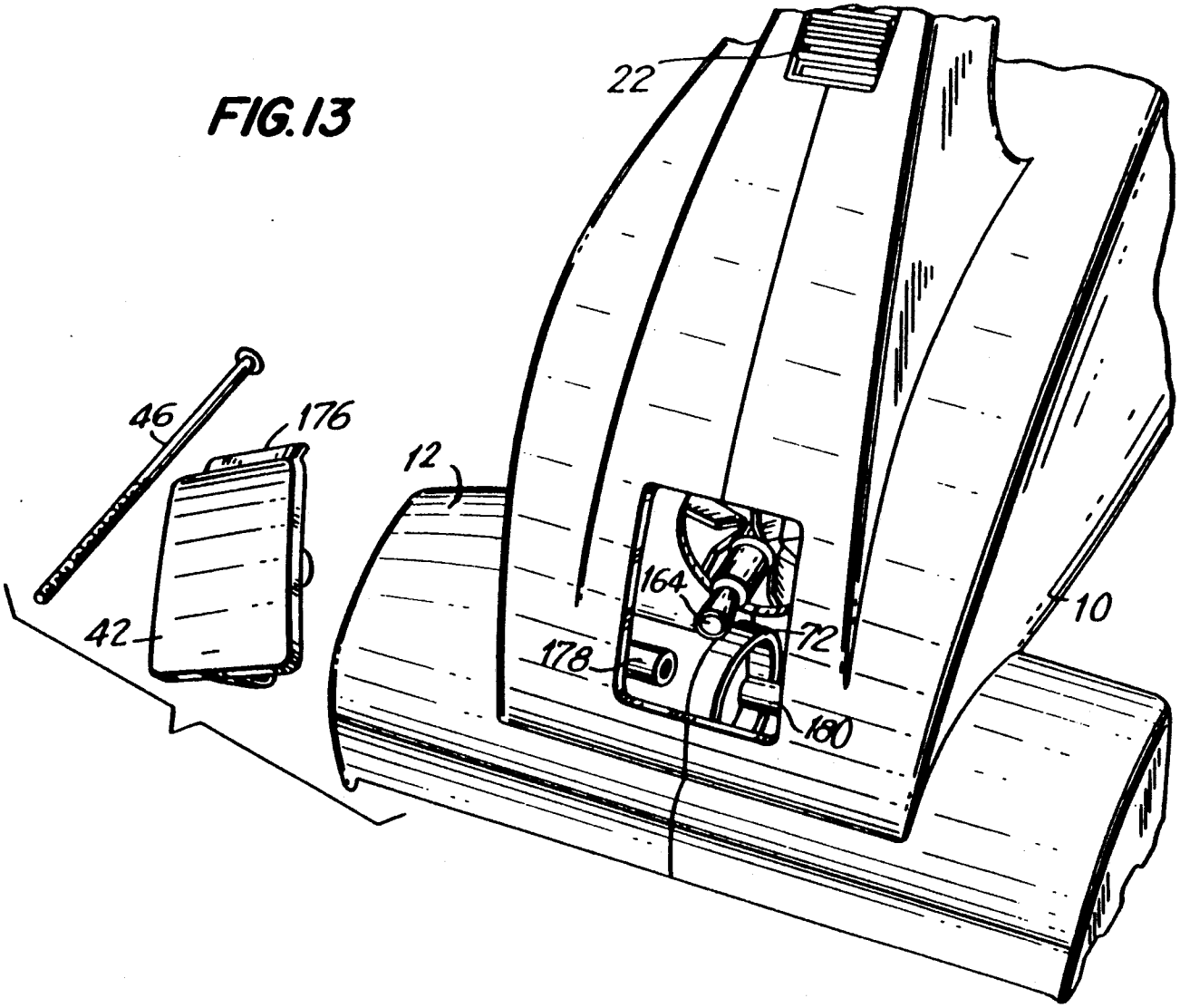
FIG. 13 is a view similar to FIG. 12 but from a slightly different angle and showing the belt separated from the motor and pulley.
Figure 14:
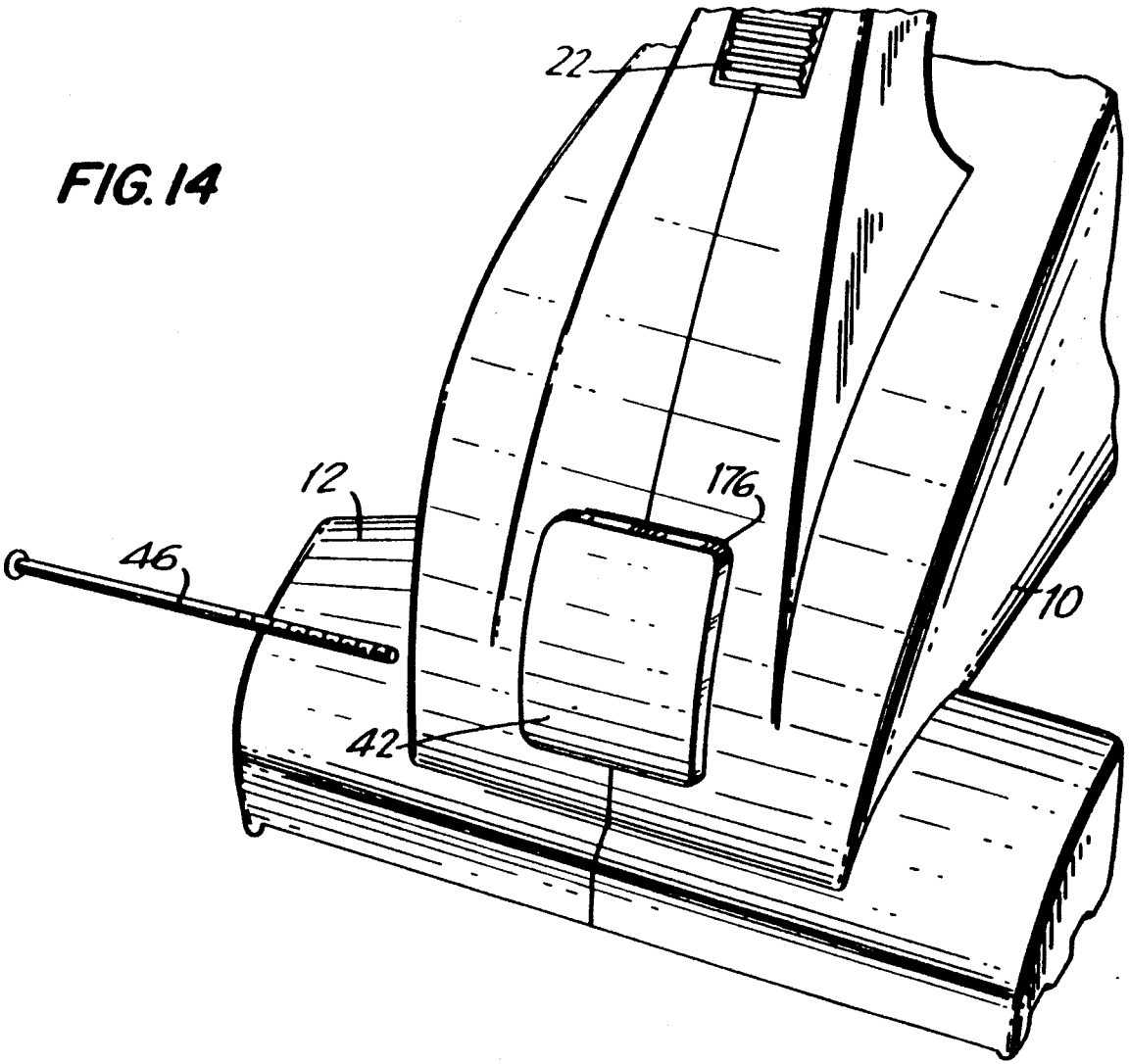
FIG. 14 is a view similar to FIGS. 12 and 13 showing the door in process of installation.
Figure 15:
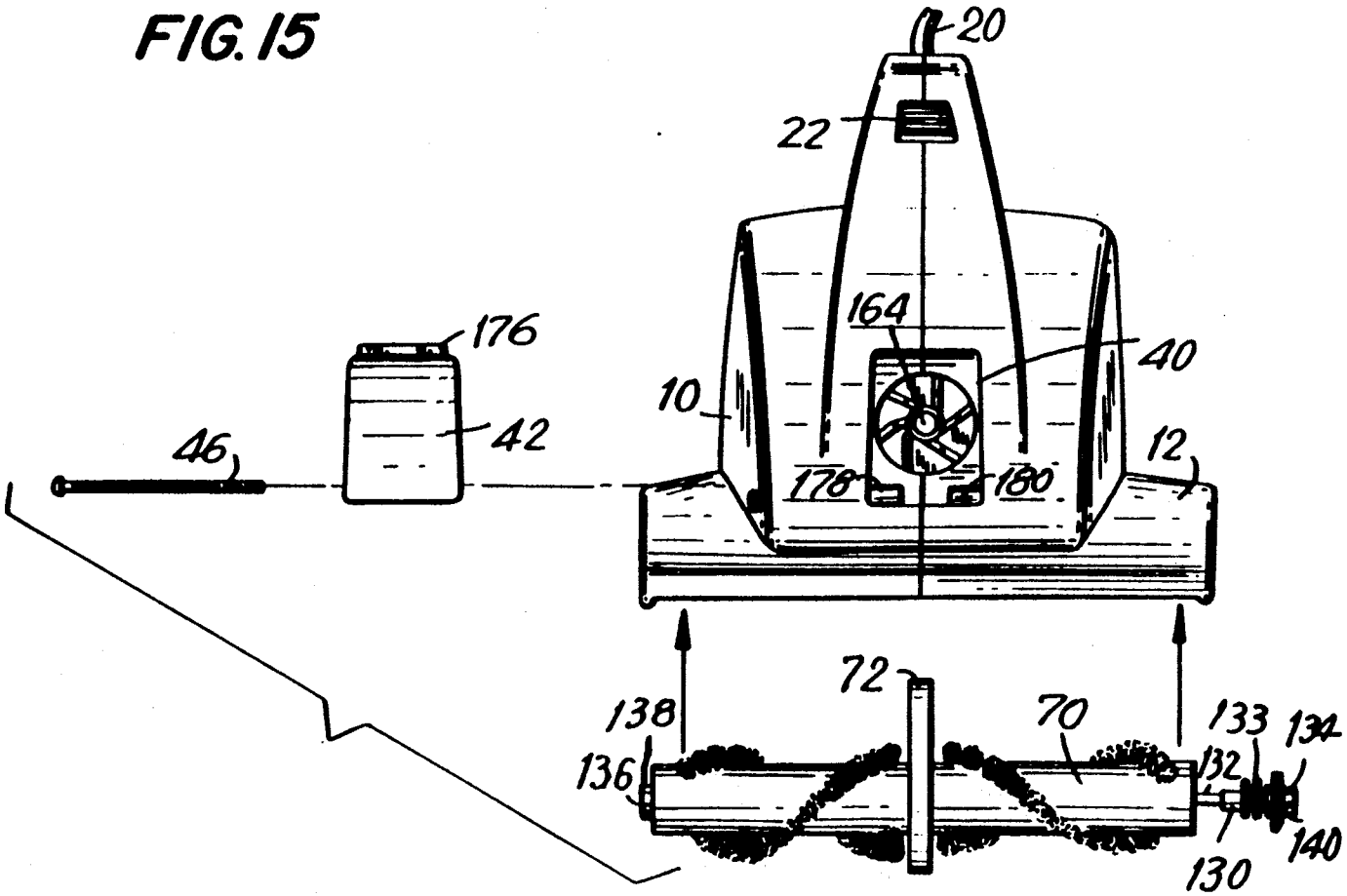
FIG. 15 is an exploded view showing the brush partially disassembled from its shaft and end caps, the door and its retaining screw and the belt around the brush.

In attaching the bag assembly 16, a recess in the collar 81 is used. This recess engages a projection or rib 96 (see FIG. 11) which is diametrically opposite to the detent opening 90.. The rib 96 and the indentation 94 form a fulcrum, when they engage, around which the bag and collar can pivot as the side opening 82 moves over and into alignment with the detent button opening 90 and the detent button 88 snaps outwardly into the side opening 82 to lock the bag assembly in place at the rear of the housing 10. It will also be noted that the end section 84 has an outer peripheral wall which is recessed below the outer peripheral wall of the housing to define a step 98. This step is approximately the thickness of the collar 81. The exterior surfaces of the collar 81 and the housing are thus aligned with each other so that they appear to be continuous.

The bag assembly 16 is also shown in FIGS. 26A, 27A, 28, and 29. The gasket 80 is a ring of elastomeric plastic, such as PVC (e.g. 60 durometer) having an annular groove 100. The collar 81 is formed with a tongue 102, also annular, which receives the groove 100. The bag 18 may be sewn to the gasket ring 80. When the bag 18 becomes excessively dirty, it may be pulled out together the gasket and washed and then replaced. The frictional tongue and groove fit holds the bag assembled to the collar 81 and facilitates removal thereof for cleaning or replacement.

As mentioned above, the gasket 80 is recessed within the collar 81 a distance from the side opening 82 to form a seal by abutment upon assembly. This distance or spacing of the gasket 80 is somewhat less than the distance between the gasket 80 and the front edge 91 of the collar 81. Thus, the gasket 80 will abut and form a seal with the rear face 89 of the end section 84 before the edge 91 meets the step 98.

The compartment 92 has, around the opening 88, a lip or pair of lips best indicated at 104 and 106 in FIG. 8. The detent button 88 has side walls 106 from which tapered snap over or detent tabs 108 extend. The side walls define a compartment or pocket in which a rectangular body 110 of elastic material, such as an open celled foam rubber with resilent characteristic foam, is located. Upon assembly the body 110 enters the compartment 90 and forms a spring between the rear of the face of the detent button 88 and the rear wall of the compartment 90. The spring tabs 108 snap over the lip and prevent the button from leaving the compartment 90. The spring body 110 biases the button outwardly. The wedge or tapered shape of the button 88 is also shown in FIG. 28.

FIG. 9 illustrates the hi-part housing 10 in process of being assembled. It will be observed that there is a deflector plate or partition 112 at the exit of the dirt channel 88. This partition enters into the snout 86.

Consider next the agitator brush. The agitator brush includes a brush roll 120 having at least one row of tufts or bristles helically disposed thereon. (See also FIGS. 31 and 32). The brush roll may be made of wood or plastic. It has an axial opening or bore 126 with steps 128. These steps receive bearings 130 which may be of suitable bearing material (e.g., oil impregnated sintered iron).

A shaft 132 extends through the axial hole 126. This shaft has end caps 134 and 136 at the opposite ends thereof. It will be appreciated that the shaft is held stationary while the brush and bearing rotate about it. The end caps have flanges which enter into annular grooves at the ends of the brush roll 120 and impede the entry of loose threads and dirt into the bearing shaft interface. A thrust washer 133 is located between the end cap 136 and the bearing 130 adjacent thereto. Only one thrust washer is needed because the resultant forces due to the belt act in one direction. The end cap 136 has a round (circular) boss 138. The end cap 134 has a circular boss 140 with flats 142. There may also be plastic spacers 133 on the outside faces of the bearings 130 as shown in FIG. 18.

Figure 16:
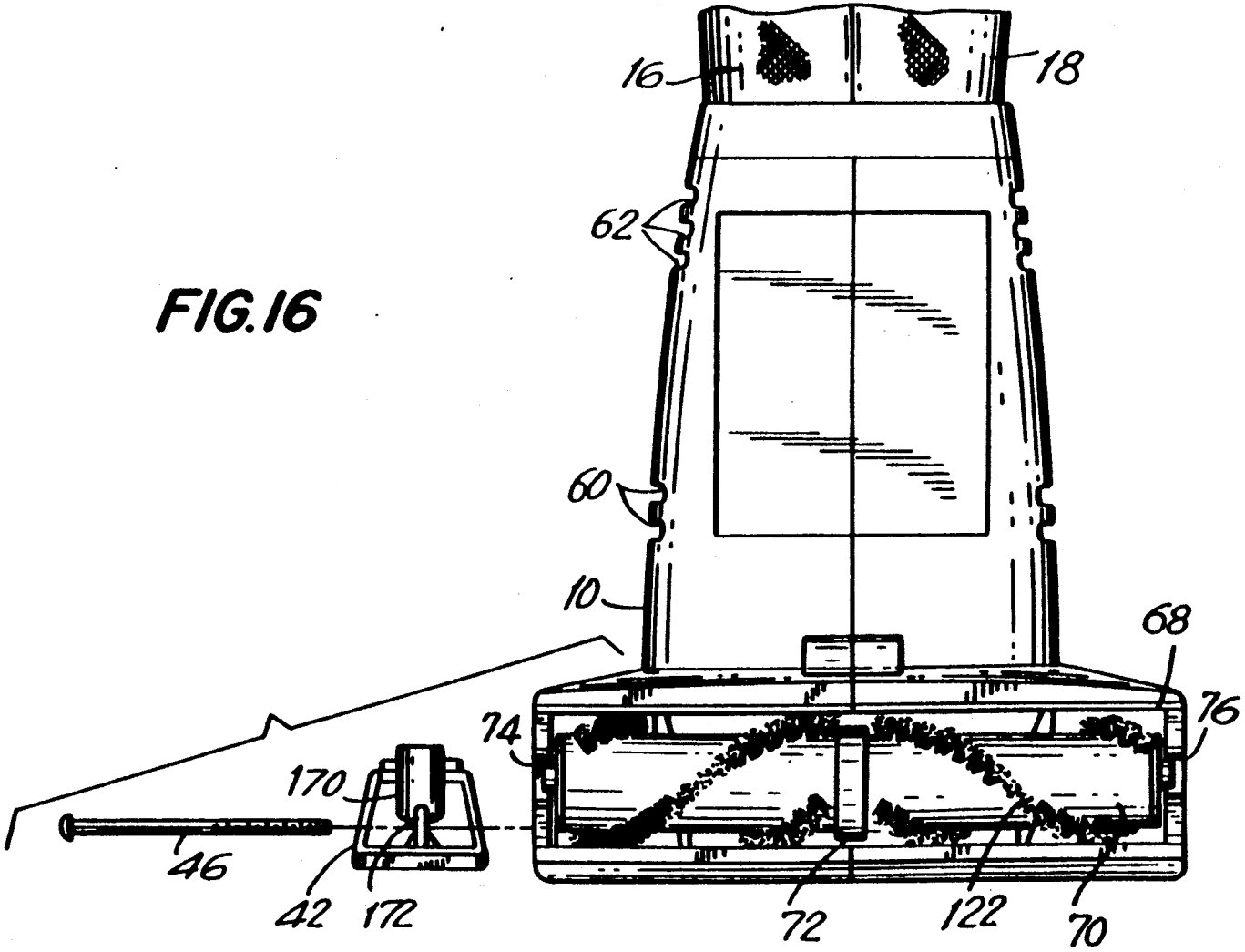
FIG. 16 is a view showing the bottom of the vacuum cleaner with the brush installed and showing the rear of the door with its projecting post and the retaining screw.

As best shown in FIG. 16 the receptacles 74 and 76 have their walls formed with inward projections 77 (such as wedges or barbs—see also FIG. 21) which define areas in the receptacles 74 and 76 in which the end caps 134 and 136 are received. The end caps 134 and 136 may be made of plastic, such as acetal. The distance across the diameter (across the flats 142 in the case of the end cap 134, when the projections are on the side walls of the ribs forming the receptacles) is smaller than the distance between the projections between the side walls. If the projections are only on the end walls, then the axial distance between the end caps is greater than the axial distance between the projections. In other words, there are two alternative assembly means. Therefore, the brush assemblies are snapped into the receptacles and are held there without falling out, even if the belt 72 breaks and in spite of there being no sole plate or other hold-in device for the brush 70.

It will be noted that the receptacle 74 is wider than the receptacle 76 between their side walls. This enables the brush to be inserted one way with the larger end cap 136 in the larger receptacle and the smaller end cap 134 into the smaller receptacle. This selective assembly assures that the thrust washer 133 will be in a position to take the thrust forces due to the belt.

Figure 18:
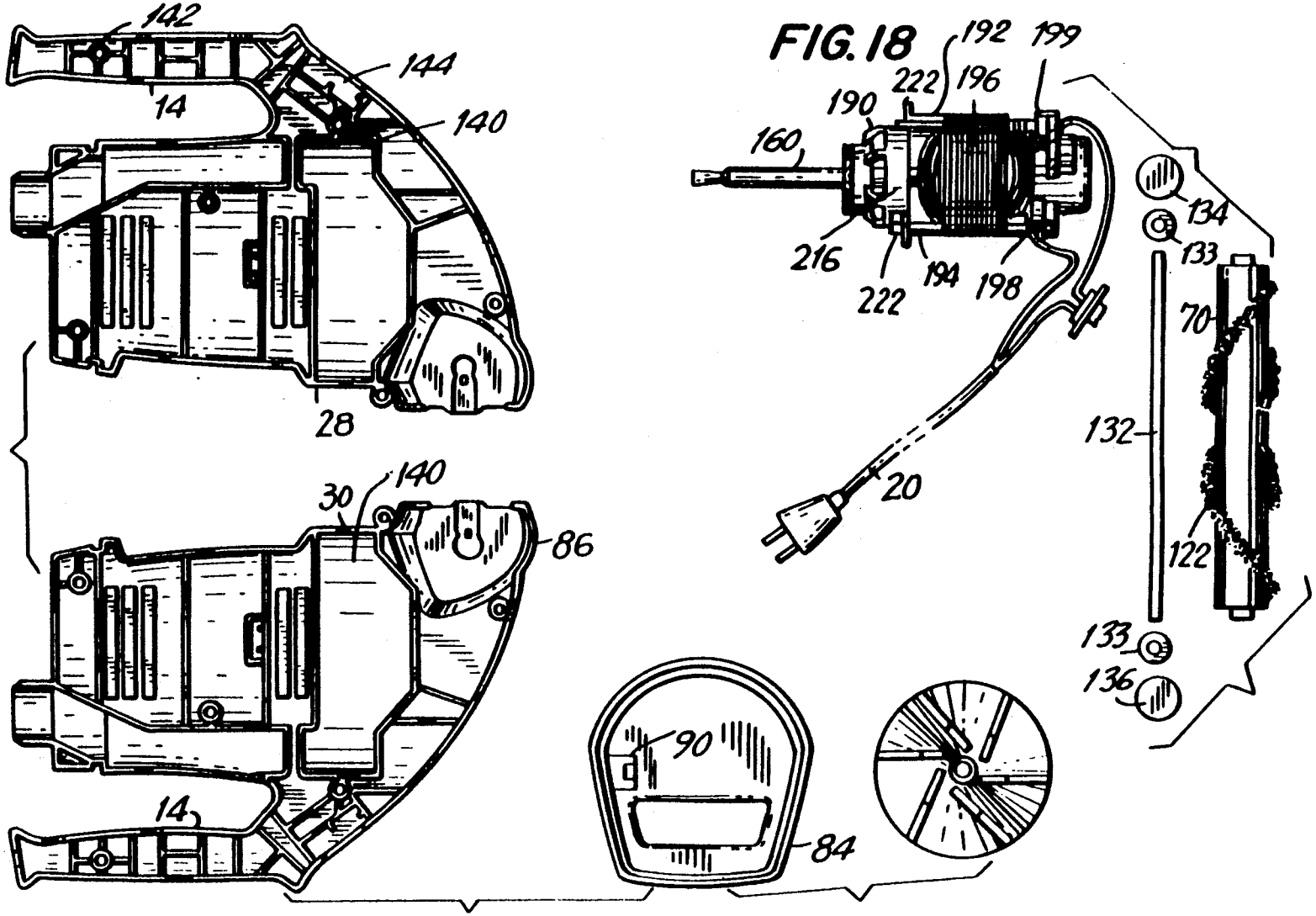
FIG. 18 is an exploded view showing the halves of the housing, the end section of the housing, the motor, the fan, the brush, the brush shaft, the brush shaft end caps and the power line cord connected to the motor.

Referring to FIGS. 18, 19 and 20 it will be seen that the housing halves 28 and 30 are mirror images of each other. They define the motor compartment 26, a fan compartment 140 and the nozzle compartment 86.

The handle 14 is hollow and has a post 142 around which the line cord 20 extends and is held so as to provide strain relief. The handle also has a pocket 144 in which the switch 22 is disposed (see especially FIG. 20). The wires for powering the motor 24 extend through a conduit tube 145. The tube 145 extends through the dirt channel 88 (see FIG. 20). The conduit tube 145 may be formed by hemi-cylindrical sections molded in the housing parts 28 & 30. See FIG. 21.

The housing halves 30 and 28 are formed with alignment posts and holes and may be glued together. In a preferred embodiment as shown in FIG. 21, which shows the housing half 30 (the other half 28 being a mirror image), six holes 146 which receive self-threading screws through aligned holes in the other housing part 28 are used to assemble the parts together. Tongues 148 (see also FIGS. 22 to 24) which are received in grooves in the other housing part 28 define the partitions between these housing halves and make the compartments 26, 140 and 86 sufficiently airtight.

Figure 17:
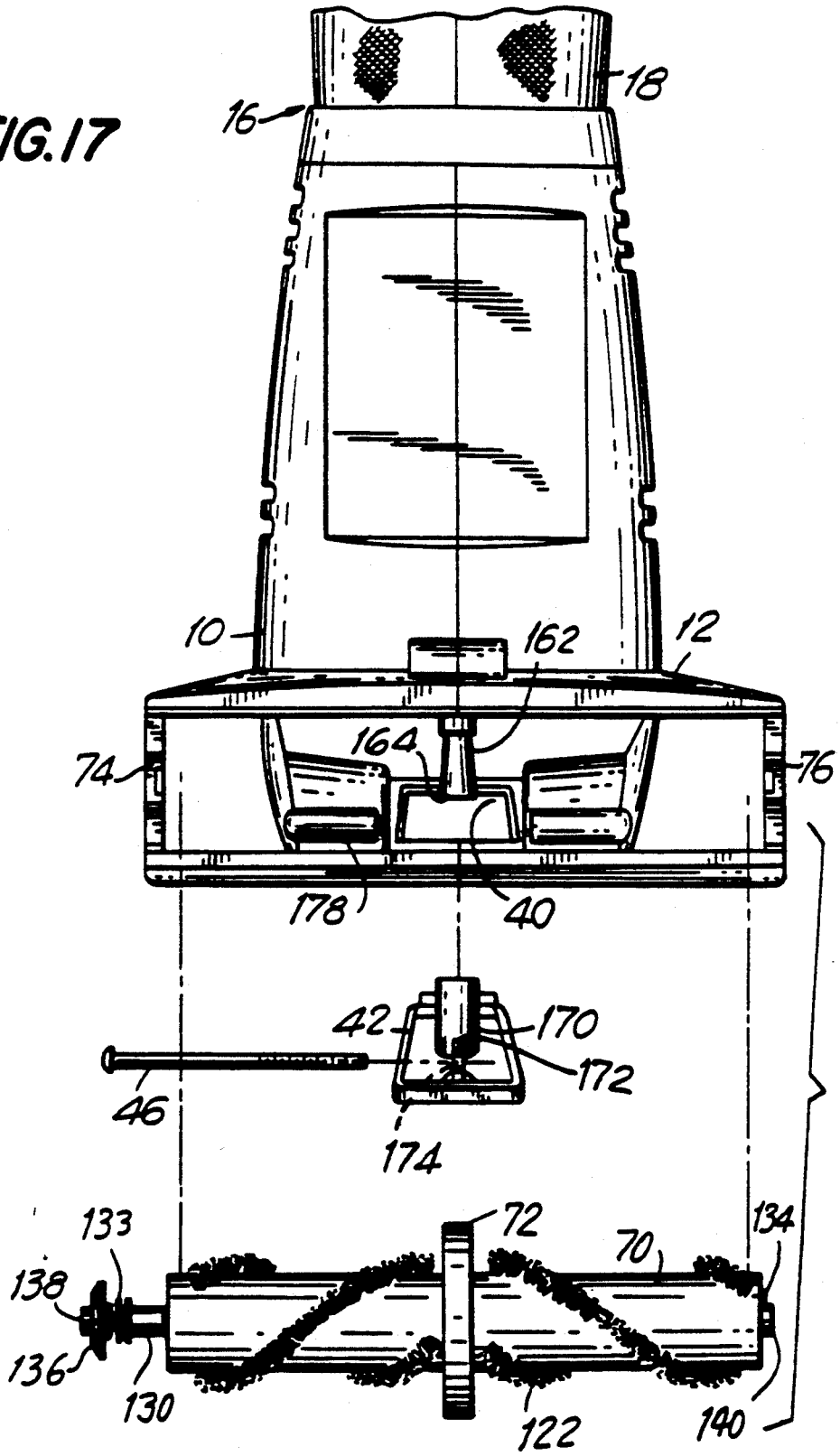
FIG. 17 is an exploded view showing the bottom of the vacuum cleaner housing with the bag assembly removed and particularly showing the nozzle compartment with the motor shaft extending therein, the door from the rear and its retaining screw and the brush with its shaft and one end cap partially removed from the brush and the belt around the brush.

The motor 24 has a shaft 160 with a belt pulley section 162 at the forward end thereof. The free end 164 of the motor shaft faces the opening 40 as best shown in FIG. 20. The door 42 (see FIG. 17) has a hollow post 170 and a gusset 172 with a hole 174 therethrough. The post and gusset 170/172 are on the inside of the door and the door has a lip 176 which engages the upper edge of the opening 40. The axis of the post 170 is aligned with the end of the shaft end 164 and the post is of larger diameter than the shaft end. When closed the post 170 is in the immediate proximity (slightly spaced from the end 164. However, the belt will engage the end of the post 170 and cannot slip off the pulley 162. To secure the door 42 in place, the screw 46 passes through a sleeve section 178 from the hole 44 into a threaded bore 180. The screw extends through the hole 174 in the gusset 172. When the screw is tightened down, the door cannot move out of position and the post 170 is kept in the immediate proximity of the end 164 of the shaft 160. Instead of a cylindrical post, the post may be a cross or bar in cross-section which extends beyond the diameter of the shaft end 164.

Returning to FIGS. 18 to 21 it will be seen that the motor 24 has a cage 190 with ribs providing passages. This cage is connected through bridges 192 and 194 which attach the cage to the stator of the motor which includes coils and laminations 196. Further bridges 198 connect the brush and rear bearing bracket assembly 199 of the motor to the rest of the motor. The armature is wound on the shaft and there is an annular space extending longitudinally between the armature and the stator (laminations and stator coil 196) section. The stator section has flats, one of which is indicated at 200, the other flat is diametrically opposite to the flat 200. These flats are shown at 200 and 200' in FIG. 30. The cage 190 contains a bearing for the shaft 160. Another bearing is contained in the brush and rear bearing assembly 199.

The motor is contained in the motor compartment 26. A pair of partitions 202 and 204 (which are formed when the housing halves 28 & 30 are assembled) divide the motor compartment 26 into three chambers, namely, an inlet chamber 206, and outlet chamber 208 and a cooling chamber 210 intermediate the inlet and outlet chambers 206 and 208. The shape of these partitions and especially the shape of the holes therethrough in which the motor is mounted is best shown in FIGS. 22 and 23 which show halves of each hole. The mirror image of these sections in the housing part 28 completes the partitions. The hole 214 formed in the partition 202 is circular, while the hole 216 in the partition 204 is circular with flats 218. The rear ring 193 of the cage 190 fits in the circular opening 214. The flats 200 & 200' on the laminations of the stator 196 are located against the flats 218 and fit in the opening 216 in the partition 204. The rear wall 220 of the motor chamber also has an opening 223 which receives the bearing cups of the brush and bearing assembly 199 of the motor 24.

The inner ring 193 of the cage 190 has tabs 222 which fit into pockets 226 (see also FIG. 25). This further maintains the motor 24 in position and prevents the rotation of the stationary parts thereof. The motor is merely dropped into one half section 30 and the other half section placed on to trap and secure the motor in place.

Cooling air enters the inlet vents 34 around the louvers into the inlet chamber 206. Exhaust or heated air leaves around the louver 62 through the outlet vents 38 from the outlet chamber 208. The only passage for air between the inlet and outlet chamber is through the motor. The cooling chamber has no vents and no communication with the inlet and outlet chambers except through the passageways in the motor. A motor cooling fan inside the brush cage which is shown at 230 in FIG. 30 assists in drawing inlet air into the inlet chamber 206.

The suction fan 240 has a conical base 242 from which extend a plurality of blades 244 which are spaced at angular increments from each other around the base 242. The fan 240 also has a collar 246 (see FIG. 30). This collar is provided with a metal insert 248 which is preferably ultrasonically bonded in the axial bore 250 of the collar 246. A metal (e.g., brass) softer than the metal (e.g., steel) of the shaft 160 is used for the insert. The portion of the shaft 160 on which the fan is mounted is provided with a plurality of splines 252, for example four splines which are spaced from each other around the periphery of the shaft. The fan is mounted by pressing it over the splines, in effect swaging the insert to the splines 252. This may be done in a press with a stop to assure that the fan is located on the shaft portion which is located in the fan chamber 86.

From the foregoing description it will be apparent that there has been provided an improved hand-held vacuum cleaner, variations and modifications of the herein described vacuum cleaner and the various features thereof will undoubtedly suggest themselves to those skilled in the art. Accordingly, the foregoing description should be taken as illustrative and not in a limiting sense.

We claim:

1. In a hand-held vacuum cleaner having a housing containing a motor, a power line cord for supplying electricity to said motor, the improvement for securing said line cord when said cleaner is not in use comprising a wall portion of said housing with a cylindrical surface extending longitudinally of said housing, a flat surface across said cylindrical surface defining opposing walls spaced longitudinally from each other to define a well for said line cord, and a second surface having spaced projections defining a second well positioned opposite to said first flat surface on said housing, said line cord being windable around said well and said second well.

2. In a hand-held vacuum cleaner having a housing containing a motor, a power line cord for supplying electricity for operating said motor, the improvement for securing said line cord when said cleaner is not in use comprising a wall portion of said housing with a cylindrical surface extending longitudinally of said housing, a flat surface across said cylindrical surface defining opposing walls spaced longitudinally from each other to define a well for said line cord, and further including a handle connected to said housing, said handle having spaced projections defining a second well opposite to said well on said housing, said line cord being windable around said well in said housing and said second well in said handle.

* * * * *